United States Patent [19]

Kofler

[11] 4,420,861

[45] Dec. 20, 1983

[54] WARP BEAM LOADING AND UNLOADING APPARATUS FOR A WARPING MACHINE

[75] Inventor: Wilhelm Kofler, Uzwil, Switzerland

[73] Assignee: Maschinenfabrik Benninger AG, Uzwil, Switzerland

[21] Appl. No.: 181,489

[22] Filed: Aug. 26, 1980

[30] Foreign Application Priority Data

Sep. 13, 1979 [CH] Switzerland ..... 8279/79

[51] Int. Cl.[3] ..... D02H 3/00

[52] U.S. Cl. ..... 28/196; 28/208; 242/56.8; 242/65

[58] Field of Search ..... 28/196, 197, 201, 208; 242/56.8, 65

[56] References Cited

U.S. PATENT DOCUMENTS

| | | | |
|---|---|---|---|
| 2,382,760 | 8/1945 | Wiggermann | 28/196 |
| 2,485,382 | 10/1949 | Howes | 28/196 |
| 2,663,067 | 12/1953 | Roughsedge et al. | 28/196 |
| 2,680,896 | 6/1954 | Groce et al. | 28/196 |
| 2,955,897 | 10/1960 | Noe | 28/196 |
| 3,165,808 | 1/1965 | Browne et al. | 28/196 |

FOREIGN PATENT DOCUMENTS

| | | | |
|---|---|---|---|
| 432406 | 9/1967 | Switzerland . | |
| 669964 | 4/1952 | United Kingdom | 28/196 |

*Primary Examiner*—Robert Mackey
*Attorney, Agent, or Firm*—Werner W. Kleeman

[57] ABSTRACT

In order to pivot lifting forks and press or contact roll arms, there is employed a single cylinder unit acting by means of a piston rod upon a crank arm of a shaft member. Rotation of this shaft member causes, by means of the press roll arms connected rigidly for rotation with such shaft member, pivoting of a press or contact roll. A lever which likewise is rigidly connected for rotation with the shaft member is hingedly connected with a pair of brackets at whose other end there is located a guide roller or roll which travels in a slotted guide of a guide lever carrying one of the lifting or lift forks for the lifting-in and lifting-out of the warp beam. The other lifting fork is carried by a second analogous guide lever. Both of the guide levers are operatively connected with a pivotal shaft. The arrangement is carried out such that during rotation of the shaft member operated by the cylinder unit through a first angular range or region only the contact or press roll performs a pivotal movement, whereas the guide roll moves without any effect within the slotted guide. Only during a further angular range of rotation of the shaft member, which follows the first angular range of shaft rotation, are the guide levers and therewith the lift forks rocked by the action of the guide roll which bears at the end of the slotted guide.

3 Claims, 6 Drawing Figures

WARP BEAM LOADING AND UNLOADING APPARATUS FOR A WARPING MACHINE

CROSS-REFERENCE TO RELATED CASE

This application is related to the commonly assigned, copending United States application Ser. No. 181,490, filed Aug. 26, 1980, of Wilhelm Kofler, entitled "Apparatus For Clamping And Unclamping a Warp Beam In a Beam Warping Machine".

BACKGROUND OF THE INVENTION

The present invention relates to a new and improved construction of apparatus for a beam warping machine for lifting-in and lifting-out the warp beam and for feeding and uniformly pressing a contact or press roll against the warp beam during operation of the machine and for lift-off of the contact or press roll.

Generally speaking, the apparatus of the present development comprises lift forks or fork members which are pivotable about a rotational axis and serving for the lifting-in and lifting-out of the warp beam. Further, there are provided a pair of press or contact roll arms which radially protrude away from a common shaft coaxially arranged with respect to the aforementioned rotational axis and are rigidly connected for rotation with such shaft, these pair of press roll arms serving for the advancing and lifting-off of the press or contact roll which is mounted between these arms.

In the case of beam warping machines employing a direct drive, the warp beam is directly placed into rotation by means of its shaft, whereas in the case of beam warping machines working with indirect drive, the rotation of the warp beam is accomplished at its circumference with the aid of a drive drum. This drive drum, apart from accomplishing the circumferential drive, simultaneously also insures for the requisite density of the wound-up threads or the like. In the case of beam warping machines with direct drive, a cylindrical roll, the so-called press or contact roll, serves to produce the required density of the threads during their winding-up onto the warp beam. This press or contact roll, during the warping operation, is pressed with a uniform pressure against the warp beam and while maintaining the same contact pressure moves in accordance with the increasing diameter of the warp beam. In order to lift-in and lift-out the empty and/or full warp beam, the contact or press roll, as a rule, can be lifted into a rest or idle position.

Additionally, with beam warping machines of the aforementioned two species there are provided, as a general rule, devices in order to raise from the floor or ground an empty beam which has been rolled into the machine up to an elevational position where it coacts with laterally engageable clamping and entrainment devices which are used during the warping operation.

Heretofore, there were employed for the lifting-in and lifting-out of the warp beam and for the advancing and lifting-off of the press or contact roll, rods and drive devices (lift cylinder) which were independent of one another. Since these devices had to transmit appreciable forces, their components must be correspondingly dimensioned. Hence, there resulted complicated and correspondingly expensive constructions for each of both such devices.

This is also the case, for instance, with the construction proposed in Swiss Pat. No. 432,406, wherein by virtue of the fact that both the lifting lever for the warp beam and also the arms of the press roll are arranged upon a single shaft, there is realized a certain simplification of the transmission elements, but wherein however there are required separate controls and lift cylinder for the actuation of each of both devices, and thus just as was previously the case, requires a considerable expenditure.

The heretofore known devices additionally have common to them the drawback that the possibility afforded by the construction of independently as well as also simultaneously actuating both of the devices, requires appreciable safety measures in order to exclude to the extent possible faulty manipulations.

SUMMARY OF THE INVENTION

Therefore, with the foregoing in mind, it is a primary object of the present invention to overcome the aforementioned drawbacks and limitations of the prior art constructions.

Another and more specific object of the present invention aims at providing an apparatus of the character described which enables appreciably reducing the structural and material expenditure in relation to heretofore known equipment and at the same time insuring in a most simple manner the correct working sequence of both devices, especially preventing faulty manipulations, for instance the simultaneous actuation of both such devices.

A further significant object of the present invention aims at providing a new and improved construction of apparatus for a beam warping machine for lifting-in and lifting-out the warp beam and for feeding and uniformly pressing the contact roll against the warp beam during operation of the machine and for lift-off of the contact roll, in a manner not associated with the aforementioned drawbacks and limitations of the prior art constructions, and which apparatus is relatively simple in construction and design, extremely reliable in operation, economical to manufacture, not readily subject to breakdown or malfunction, and requires a minimum of maintenance and servicing.

Now in order to implement these and still further objects of the invention, which will become more readily apparent as the description proceeds, the apparatus of the present development is manifested by the features that the pivoting of the lift forks or fork members and the press roll arms is accomplished by a single cylinder which acts upon the aforementioned shaft. The lift forks are actuated by a lever which likewise is rigidly connected with the aforementioned shaft, the lever actuating the lift forks by means of a hinge connection. In particular, the lift forks or fork members are actuated in a manner such that a rotation of the common shaft through a first angular range only rocks or pivots the press or contact roll and only when the shaft is rotated through a further angular range which, follows the first angular range, is there also rocked the lift forks.

Thus, as an appreciable structural simplification of the heretofore known devices, there is only required a single cylinder which is effective at the rotational shaft both for the pivoting of the press roll and also for the actuation of the lift forks for the lifting-in and lifting-out of the warp beam. Additionally, the control is not only simplified, but also there are practically eliminated faulty manipulations.

An advantageous construction of the inventive apparatus is realized if the lever generating the lift fork-rocking or pivotal movement is hingedly connected with the one end of a pair of bracket members or brackets which extend in the same direction, the other end of such bracket pair carrying a guide roll or roller. This guide roller protrudes into a slotted guide of a guide lever which when actuated pivots the lift forks. The arrangement is carried out in a manner such that in the first mentioned angular range, the guide roller slides within the slotted guide without rocking or pivoting the guide lever and during the aforementioned second angular range, the guide roller bears at the end of the slotted guide and rocks the guide lever.

For the actuation of the second lift fork, there can be provided, as an advantageous solution, an arrangement wherein the guide lever possessing the slotted guide opening is fixedly clamped upon a pivot shaft forming the pivot axis, at which there is fixedly clamped in the same manner a second guide lever supporting and rocking the second lift fork or fork member.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENT

Figure 1:
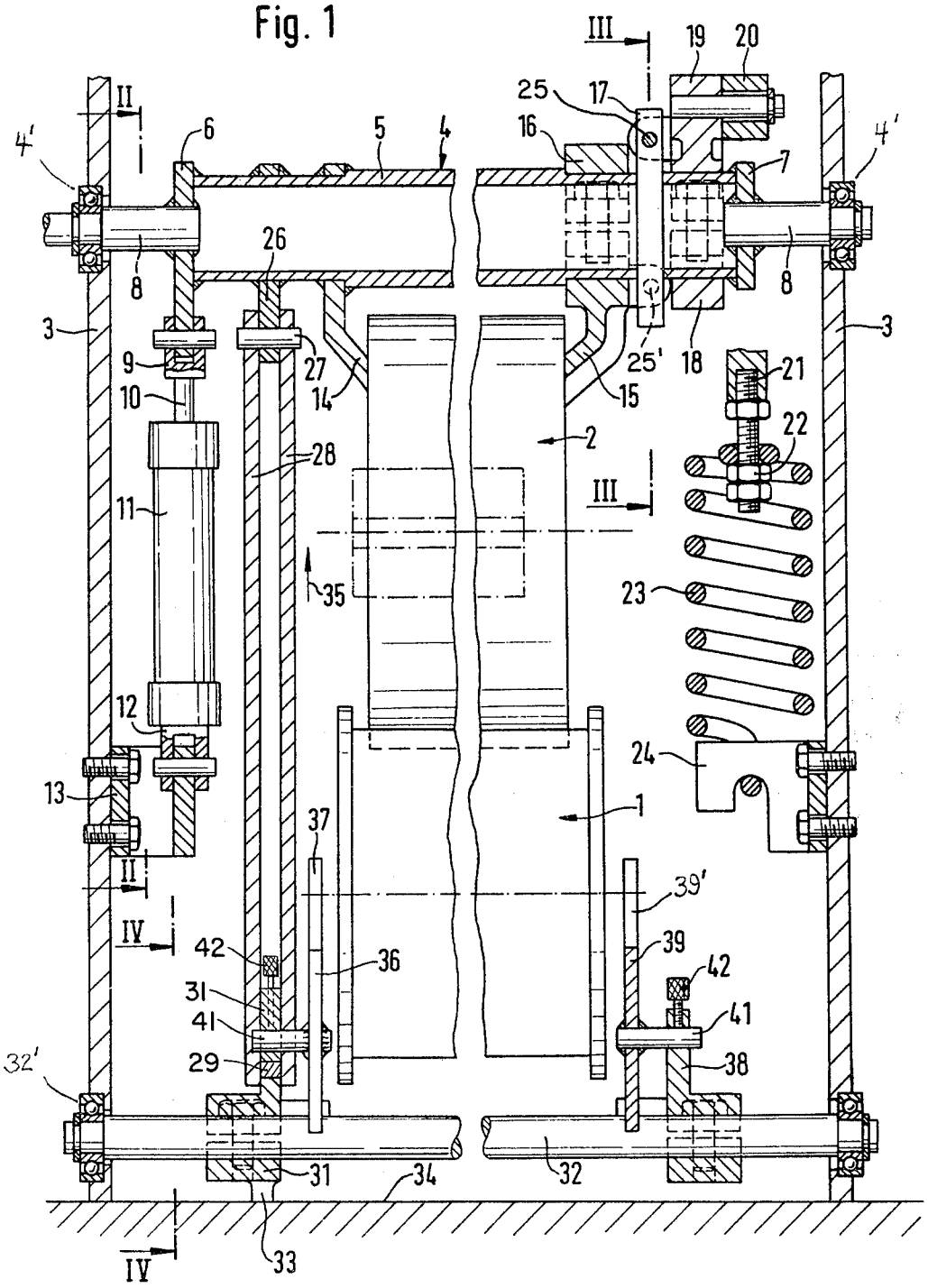
FIG. 1 is a partially sectional elevational view of an apparatus according to the invention wherein for improving clarity in illustration there have been omitted the lateral clamping and entrainment devices for the warp beam.

Describing now the drawings, it is to be understood that only enough of the beam warping machine has been shown in the drawings to simplify the illustration and as needed for one skilled in the art to readily understand the underlying principles and concepts of the present development. Turning attention now to FIG. 1, the warp beam which is to be wound with the warp threads has been designated by reference character 1 and the press or contact roll which extends parallel to the warp beam 1 during the warping operation and presses against such warp beam 1 has been designated by reference character 2. The mounting and the elements for braking the contact or press roll 2, as well as the devices for chucking or clamping and entraining the warp beam 1, have not been particularly shown since such structure may be of conventional design. It is however mentioned that an advantageous construction of apparatus for clamping and unclamping a warp beam in a beam warping machine constitutes the subject matter of the aforementioned copending United States application referred to at the outset of this disclosure.

Arranged parallel to the lengthwise axis of the warp beam 1 and the contact or press roll 2, between the side walls or plates 3 of the illustrated apparatus, is a shaft 4 which is freely rotatable within the ball bearings 4'. The shaft 4 is composed of a robust tubular section 5 which is adequately dimensioned so that it is torsion-free and at its ends is provided with the thereto affixed, for instance welded, closure plates or disks 6 and 7 which support the bearing journals 8 for the mounting of the shaft 4.

The closure disk 6 is constructed as a crank arm or rod at which there is hingedly connected the bifurcated-shaped end 9 of a piston rod 10. The related double-acting cylinder has been generally designated by reference character 11. This cylinder or cylinder arrangement 11 is pivotably secured at its end 12, constructed as a bifurcated or forked foot portion and which is located opposite to the departure or outlet end of its piston rod 10, by means of a cylinder block 13 at one of the side walls 3, as best seen by referring to FIG. 1.

Figure 2:
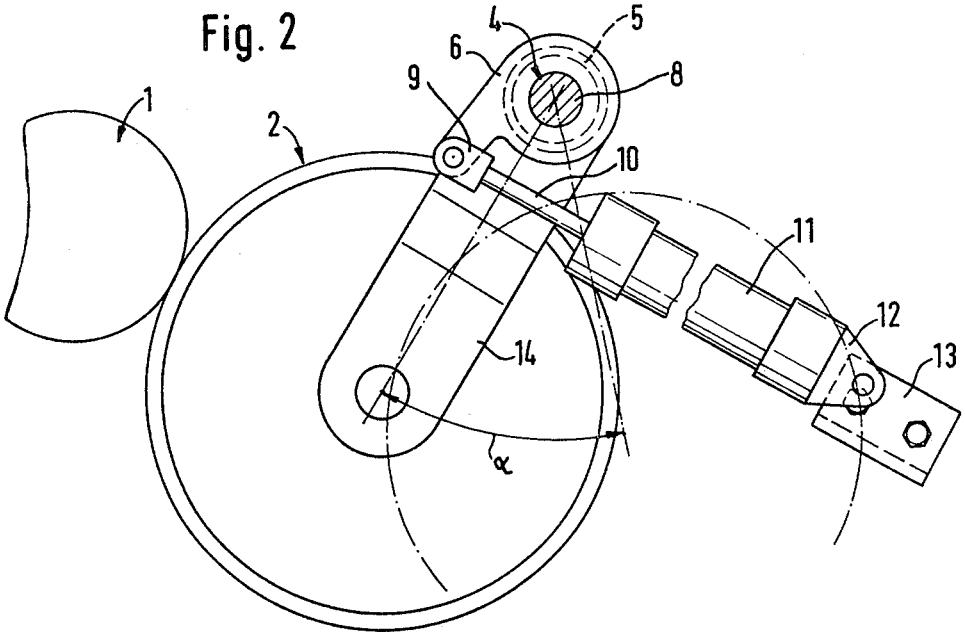
FIG. 2 is a sectional view of the apparatus of FIG. 1, taken substantially along the line II—II thereof, showing the rod arrangement used for rotating the shaft which actuates the press or contact roll and the lift forks or fork members for the lifting-in and lifting-out of the warp beam.

As also will be recognized by reverting to FIGS. 1 and 2, actuation of the cylinder 11 causes rotation of the shaft 4 throughout an angular region or range which is limited by any suitable and therefore not particularly illustrated stops.

The rotation of the shaft 4 by the cylinder unit 11, as will be explained more fully hereinafter, is beneficially employed both for pivoting the press or contact roll 2 as well as also for the lifting-in and lifting-out of the warp beam 1.

As already mentioned, the contact or press roll 2 is mounted in known manner at the free ends of two press roll arms 14 and 15, the other ends of which are rigidly connected for rotation or rigidly connectable for rotation with the tubular section or portion 5. In the illustrated embodiment, the press roll arm 14 is connected by means of a releasable or non-releasable connection fixedly with the tubular section or tube portion 5. On the other hand, the second arm 15 of the pair of press roll arms 14 and 15 is connected so as to be rotationally positionable at the tube or tubular section 5 with respect to the warp beam 1 for the purpose of enabling parallel setting or adjustment of the press or contact roll 2. To this end, the press roll arm 15 is constructed to contain a protruding clamping hub 16 or equivalent structure which encircles the tubular section 5. The clamping hub 16 can be adjusted by means of oppositely effective adjustment or setting screws, like the screws 25' 25 shown in FIG. 3, acting in opposed relationship at a fixing bolt or pin 17 piercingly extending through the tubular section 5, in order to adjust the parallelism of the press roll 2 with respect to a clamped or chucked warp beam 1, as will be explained more fully hereinafter in conjunction with the description of FIG. 3.

Figure 3:
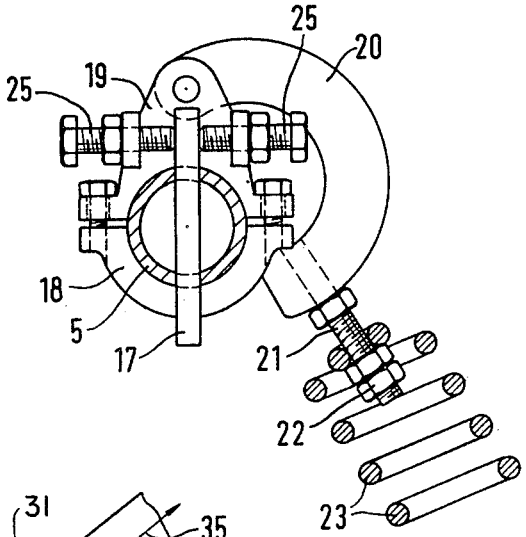
FIG. 3 is a cross-sectional view of the arrangement of FIG. 1, taken substantially long the line III—III thereof, illustrating the compensation or equalization device for the press or contact roll.

Since this adjustment device for the press roll arm 15 is analogously constructed to the adjustment device of the compensation device which will be described in relation to the illustration of FIG. 3, further details thereof have not been particularly shown in FIG. 1 but will be apparent from the subsequent description of FIG. 3 given hereinafter.

Now in FIG. 2, there has been illustrated in full lines the position of the components when the press or contact roll 2, at the start of a warping operation, has been pressed against the warp beam 1 which is not yet wound with the warp threads. With progressive warping operation the diameter of the warp beam 1 increases due to the threads which have been wound thereon, and as a result the contacting press roll 2 is rocked, against the action of the cylinder 11, about the shaft 4 serving as a rotational axis.

In broken lines in FIG. 2, there has been shown the position of the press roll 2 when it has been raised from the warp beam 1, for instance as such is necessary upon exchange of such warp beam 1. FIG. 2 therefore shows the angle $\alpha$ between both of the end positions of the press or contact roll 2.

The closure disk or plate 6 and the cylinder unit 11 are arranged such that throughout the entire pivot angle $\alpha$, with constant cylinder force, the contact or press roll 2 is pressed at a substantially uniform pressure against the warp beam 1.

In order to eliminate the inherent forces of the press roll arrangement including the shaft 4, there is provided at the end of the shaft 4 which is opposite the cylinder 11, a compensation or balancing device, the construction of which will be readily apparent from the illustrations of FIGS. 1 and 3.

As will be apparent from such FIGS. 1 and 3, a second clamping hub 18 or equivalent structure is fixed upon the tubular section 5 at the outer side of the bolt 17 in relation to the first clamping hub 16. This second clamping hub 18 carries a resilient or spring lever 19 which protrudes radially therefrom. At this resilient lever 19, there is hingedly connected a bracket 20 from which there protrudes a threaded bolt 21 at which engages by means of a double nut member arrangement 22, the one end of a coil or helical spring 23. The other end of this helical spring 23 is suspended at a spring block 24 which is secured to the side plate or wall 3. The action of the spring 23, needed for the desired force compensation, can be initially coarsely adjusted by means of the nuts or nut members 22. For the fine adjustment, which is accomplished by means of the rotational position of the clamping hub 18 upon the tubular section or portion 5, this clamping hub 18 carries adjustment screws 25 or equivalent structure, as best seen by referring to FIG. 3, which act from opposite sides upon the fixing bolt 17. These adjustment screws 25 enable an exact fine adjustment of the clamping hub 18 upon the tubular section or portion 5, exactly in the same manner as such has been previously described for the clamping hub 16, where the adjustment screws 25' (FIG. 1) which, as will be recalled may be like the adjustment screws 25, coact with the opposite end of the fixing bolt or pin 17.

The pivoting of the shaft 4 which can be produced by the cylinder unit 11, as already previously mentioned, also can be used for actuating the lifting-in and lifting-out device of the warp beam 1.

Figure 4:
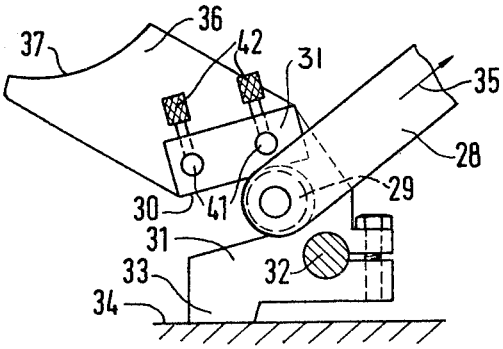
FIG. 4 is a cross-sectional view of the arrangement of FIG. 1, taken substantially along the line IV—IV thereof, serving to illustrate the actuation of the lift forks for the lifting-in and lifting-out of the warp beam.

For this purpose there is mounted rigidly for rotation with the tubular section 5, between the closure disk 6 and the press roll arm 14, a pivotal lever 26, as best seen by referring to FIG. 1. This arm or lever 26 carries at its outer end an axial pin 27, at which there is hingedly connected the one end of a pair of brackets or bracket members 28 which extend in the same direction. At their other ends, both of these bracket members 28 mount therebetween a roll or roller 29 which is guided within a guide slot 30, here shown as a substantially U-shaped guide slot in FIG. 4. This guide slot 30 is formed at a guide lever 31 which in the manner more readily apparent from the illustration of FIG. 4, is fixedly clamped for rotation at a pivot shaft 32. This pivot shaft 32 extends parallel to the shaft 4 and likewise is mounted to be freely rotatable by ball bearings 32' in the side walls 3. In the position of the parts shown in FIG. 4, the guide lever 31 bears by means of its foot portion or base 33 upon the ground or floor 34. The guide lever 31 additionally carries, by means of a releasable connection, here illustrated by the pins 41 and the adjustment screws 42, a lifting fork or fork member 36 having a concave receiving surface or pocket 37 for receiving the one end of the warp beam 1. An analogous arrangement containing a guide lever 38 which is fixedly clamped for rotation at the pivot shaft 32 and a lifting fork or fork member 39 which is releasably connected at the guide lever 38 by an arrangement of pins 41 and adjustment screws 42 as shown at the right side of FIG. 1 and having likewise a receiving surface 39' for the same purposes as the receiving surface 37 of the other lifting fork 36, is provided at the other end of the pivot shaft 32 for receiving the other end of the warp beam 1. As particularly evident by viewing FIG. 4 and as will be readily understood, a displacement of the pair of brackets 28 in the direction of the arrow 35—a movement which can be produced upon actuation of the cylinder 11 by the thus resultant rotation of the shaft 4 and the concomitant pivoting of the pivot lever 26, as soon as the roll 29 reaches the end of the guide slot 30—results in a rocking or pivoting of the guide lever 31 together with the lifting fork 36 about the axis of the pivot shaft 32. This pivot shaft 32 rotates therealong and causes a similar pivoting of the analogously constructed guide lever 38 with the second lifting fork 39. During pivoting of the shaft 4 in the opposite direction and the thus caused displacement of the brackets or bracket members 28 in a direction opposite to the direction of the arrow 35, both of the guide levers 31 and 38 are again pivoted back until the foot portion 33 contacts the ground 34. Thereafter, during further movement of the brackets 28 the guide roll 29 slides without any effect within its guide slot 30 towards the left of FIG. 4.

The mode of operation of the described apparatus now will be described in detail with reference to the schematic illustrations of FIGS. 5 and 6.

Figure 5:
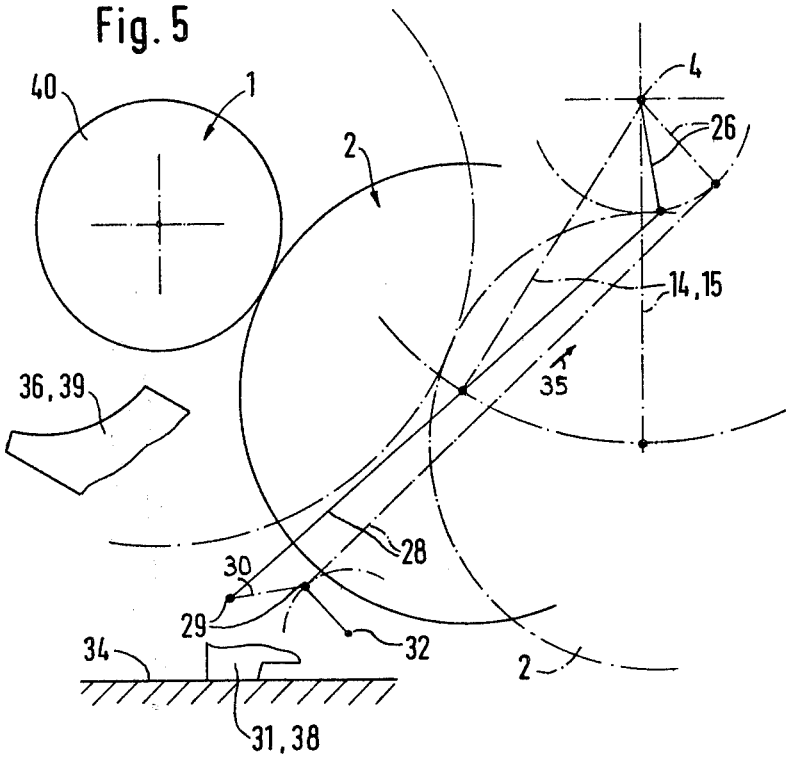
FIGS. 5 and 6 schematically illustrate the mode of operation of the inventive apparatus.
Figure 6:
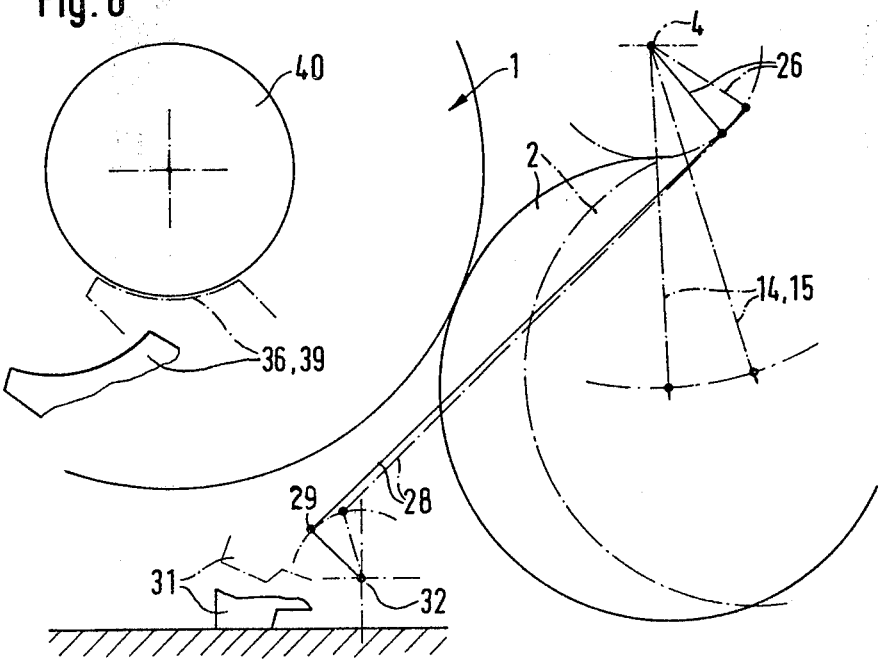

In FIG. 5 there have been illustrated in full lines all of the parts or components of the apparatus needed for understanding its function and in a position which these parts assume directly at the start of a warping operation. The still empty warp beam 1 is chucked or clamped and there is inwardly fed or advanced the contact or press roll 2. The guide levers 31 and 38 together with the displacement or lifting forks 36 and 39 for the lifting-in and lifting-out of the warp beam 1 have been shown in the lowered position according to FIG. 4.

With progressive warping operation, the diameter of the warp beam 1 continuously increases, so that the contact or press roll 2 which has been pressed thereat is pivoted about the shaft 4 serving as a pivot axis or shaft. At the end of the warping operation the parts assume the position shown in chain-dot or broken lines. The pivoting of the press roll 2 by the warp beam 1 which increases in size, causes by means of the press roll arms 14 and 15 that the pivot shaft 4 also rotates through an appropriate angular range, and therefore equally causes by means of the pivot lever 26 that the brackets 28 of the lifting-in and lifting-out apparatus will be pulled in the direction of the arrow 35 (FIG. 4). Due to this movement of the bracket members 28, the roller or roll 29 arranged at the ends of these bracket members 28 will be displaced within the guide slot 30 towards the end of such guide slot 30 appearing at the right of the showing of FIG. 4, but without such guide roll 28 having any effect, so that the position of the guide levers 31 and 38 remains unaltered.

The full warp beam 1 now must be raised and for the next warping operation, it must be replaced by an empty warp beam which has been placed in a preparatory position. To this end, by actuating the pressure cylinder 11 the shaft 4 is rotated further in the same rotational direction. This causes initially a lifting-off of the press roll 2 from the full warp beam 1, out of the position shown in full lines in FIG. 6, corresponding to the position illustrated in broken lines in FIG. 5, into the position shown in broken lines in FIG. 6. Additionally, by means of the brackets 28, the guide roll 29 is drawn such that it impacts the end of the U-shaped guide slot 30, corresponding to the showing of FIG. 4. Further rotation of the shaft 4 by the action of the cylinder unit 11 now causes by means of the hinge connection arrangement 26, 28 that the lever 31 together with the lift fork or fork member 36 will be pivoted, and thus, by means of the pivot shaft 32, the lever 38 together with the lift fork 39 is moved out of the full line position shown in FIGS. 4, 5 and 6 into the broken line position of FIG. 6, at the region of the warp beam shaft 40, whereafter the latter after releasing its horizontal chucking device, bears upon the lifting forks 36 and 39.

Now the cylinder unit 11 is operated in the reverse direction. There is accomplished a rotation of the shaft 4 in the reverse direction, and thus, a lowering of the lifting forks 36 and 39 and together therewith the warp beam 1 which is carried thereon, until such warp beam 1 bears upon the ground 34. Shortly thereafter, the lifting forks 36 and 39 then assume the position illustrated in FIG. 4.

The full warp beam 1 now is rolled away and there is rolled into its place an empty warp beam. Now the lifting or pressure cylinder unit 11 again is actuated so as to be effective in the first-mentioned direction, there then initially occurs a raising of the lifting forks 36 and 39 until contact with the warp beam 1 and thereafter the lifting of the warp beam 1 up to the region of its clamping and entrainment device. After the clamping or chucking of the empty warp beam 1, the cylinder unit 11 again is activated so as to be effective in the reverse direction. Hence, the lifting forks 36 and 39 are again lowered into the position of FIG. 4 and at the end of this movement, during which the guide roll 28 moves forwardly without any effect in its guide slot 30, the contact or press roll 2 is pressed against the empty warp beam 1. Now there has again been established the condition shown in FIG. 5 and there can start again a new warping operation.

From the above disclosure it should be readily apparent that the described apparatus not only requires but a single double-acting cylinder unit for actuation of the press or contact roll and for the lifting-in and lifting-out apparatus for the warp beam, but additionally that there are practically eliminated any faulty manipulations because the course of the operations always are accomplished in the correct sequence or succession, something which is extremely important as to the operational reliability and for the safety of the operating personnel against accidents.

While there are shown and described a present preferred embodiment of the invention, it is to be distinctly understood that the invention is not limited thereto, but may be otherwise variously embodied and practiced within the scope of the following claims. ACCORDINGLY,

What I claim is:

1. An apparatus for use with a beam warping machine equipped with means enabling the clamping and unclamping of a warp beam at the beam warping machine and serving for lifting-in and lifting-out the warp beam and for advancing and uniformly pressing a press roll against the warp beam during operation of the beam warping machine as well as for lifting-off the press roll from the warp beam, comprising:

a first shaft defining an axis of rotation;

lifting fork members pivotably mounted for pivotable movement at said first shaft about said axis of rotation;

said lifting fork members serving for lifting-in and lifting-out a warp beam;

a second shaft;

a pair of press roll arms radially protruding from said second shaft and rigidly connected for rotation with said second shaft;

a press roll mounted between said pair of press roll arms;

said pair of press roll arms serving for advancing the press roll towards the warp beam and for lifting-off the press roll from said warp beam;

a single cylinder unit operatively connected with said second shaft for pivoting the lifting fork members and the press roll arms;

a lever rigidly connected for rotation with said second shaft;

hinge means operatively connecting said lever with said lifting fork members;

said lifting fork members being actuated by said lever through the action of said hinge means such that a rotation of said second shaft through a first angular range only pivots the press roll and only after pivoting said second shaft thereafter through a second angular range is there pivoted said lifting fork members;

said hinge means includes a pair of bracket members extending in the same direction of extent;

said pair of bracket members having opposed ends;

means for hingedly connecting said lever with one end of said pair of bracket members;

a roller carried by the other end of said pair of bracket members;

guide means including a guide slot coacting with said roller;

said guide means including a guide lever which when actuated pivots said lifting forks;

said roller sliding within said guide slot without pivoting said guide lever during such time as said second shaft moves through said first angular range; and said roller bearing at an end of said guide slot and pivotally actuating said guide lever during such time as said second shaft moves through said second angular range.

2. The apparatus as defined in claim 1, wherein:

said guide lever possesses said guide slot which is in the form of a slotted guide opening;

said first shaft defining a pivot shaft upon which there is fixedly clamped said guide lever;

said pivot shaft forming a pivot axis for said guide lever; and a second guide lever which is pivotable, and is fixedly clamped at said pivot shaft, said guide levers supporting the lifting fork members.

3. The apparatus as defined in claim 2, further including:

means for releasably securing the lifting fork members at their guide levers.

* * * * *